US005255698A

United States Patent [19]

Riley

[11] Patent Number: 5,255,698

[45] Date of Patent: Oct. 26, 1993

[54] COLLAPSIBLE TENT FRAME

[76] Inventor: Orville Riley, P.O. Box 817, Townsend, Mont. 59644

[21] Appl. No.: 867,508

[22] Filed: Apr. 13, 1992

[51] Int. Cl.[5] ..... E04H 15/38

[52] U.S. Cl. ..... 135/103; 135/108

[58] Field of Search ..... 135/106, 107, 109, 111, 135/112, 105, 103, 108

[56] References Cited

U.S. PATENT DOCUMENTS

| | | | |
|---|---|---|---|
| 1,969,260 | 8/1934 | Dixon et al. | 135/106 X |
| 2,810,390 | 10/1957 | Wallace et al. | 135/106 |
| 3,266,503 | 8/1966 | Hoiness et al. | 135/109 X |
| 4,285,355 | 8/1981 | Lundblade | 135/106 X |
| 4,702,478 | 10/1987 | Kruse | 135/107 X |
| 4,757,563 | 7/1988 | An | 135/106 X |
| 4,846,205 | 7/1989 | Knoll | 135/106 |
| 4,974,621 | 12/1990 | Lerma | 135/106 |

*Primary Examiner*—Carl D. Friedman
*Assistant Examiner*—Lan M. Mai
*Attorney, Agent, or Firm*—Douglas L. Tschida

[57] ABSTRACT

An internally mounted, collapsible tent support framework including a plurality of length adjustable support sections. Inverted V-shaped end supports slip couple to a telescoping ridge pole assembly which includes a telescoping vertical T-support and over which a fabric tent is suspended. Set screws fasteners at the ridge and T-support assemblies determine exposure length and support camp accessories. Slip couplers including coaxial inner and outer sleeves define annular coupling cavities at the end supports.

6 Claims, 4 Drawing Sheets

COLLAPSIBLE TENT FRAME

BACKGROUND OF THE INVENTION

The present invention relates to tent support frameworks, and in particular, to a collapsible framework for relatively heavyweight fabric tents.

So called "cabin" or "wall" tents have long provided working and living accommodations to livestock herders and outdoorsman. Tents of this type are typically constructed of relatively heavy weight woven fabrics, such as canvas strength materials. The tents are typically supported from an external framework and a plurality of adjustable guy ropes. The ropes are secured to the ground or various stationary anchoring points adjacent the tent and stabilize the tent against the wind and elements..

The support framework typically mounts external to the tent and comprises a number of cut saplings or poles, cut to lengths exceeding that of the tent. Ones of the poles are supported in longitudinal relation to the tent at a ridge seam and/or well seams formed between the roof and ground. The longitudinal poles, in turn, are supported from end brace members which are configured to appropriate inverted V-shapes. Pegs secure the bottom edges of the tent to the ground.

The foregoing cut frameworks have long sufficed to meet the need of an economical durable and replaceable tent support mechanism. However, the awkwardness of the relatively long, fixed length wood poles presents problems when transporting and/or storing the tent, unless new poles are cut with each re-setting of the tent. This in itself requires additional time to establish a campsite.

A further problem, especially when the campsite is uninhabited, is that the walls and roof are at all times rigidly constrained to one another. The roof is always fully expanded, which condition presents a large rain or snow collection surface. Unless the campsite is periodically attended, the retention of large amounts of snow or rain on the roof surfaces can produce a consequent weighting of the tent that can induce collapse or tearing of the fabric.

In appreciation of the foregoing difficulties, Applicant has developed a relatively light weight, collapsible, internally mounted framework which facilitates initial assembly of the tent and provides a durable support system over extended periods of tent occupancy. The framework further permits a partial collapsing of the tent during periods when the campsite is to be uninhabited to prevent collapse or damage to the tent.

SUMMARY OF THE INVENTION

It is accordingly a primary object of the present invention to provide a durable, light weight wall tent support framework.

It is a further object of the invention to provide an internally mounted collapsible assembly to facilitate transport, yet which can be readily assembled and expanded to shape.

It is a further object of the invention to provide a framework including a plurality of sections which couple to one another using set-screw fastenings, coaxial slip couplings and formed slip coupler weldments.

It is a further object of the invention to provide a weatherproof framework, wherein ones of the sections mount in telescoping relation to other sections and wherein the length fixing fasteners include portions which support other utilitarian camp accessories.

Various of the foregoing objects advantages and distinctions of the invention are achieved in a presently preferred construction which comprises a galvanized multi-section tubular framework. A telescoping ridge pole of the framework includes a pair of length extensible sections which with the aid of set-screws mount to a center telescoping, vertical T-support assembly. Eye bolts threadably secure telescoping tubes of the T-support assembly to one another, while also serving as supports for accessory items. The ends of the ridge pole include welded slip couplers for receiving pre-formed end supports, which when assembled define an inverted V-shape. The pole sections of the end supports mount to one another at coaxial sleeve couplers.

The support framework in association with peripherally positioned ground pegs and externally mounted guy ropes support the tent under typically encountered conditions. When left unattended, the guy ropes may be released to collapse the side walls and whereby the roof area is reduced, with the internal framework preventing further collapse.

Still other objects, advantages, and distinctions of the invention, as well as a detailed description of a presently preferred construction, are provided hereinafter with respect to the appended drawings. Various considered modifications and improvements are also discussed. The following description is illustrative only of one form of the invention and should not be interpreted in strict limitation thereto. The scope of the invention rather should be interpreted within the scope of the appended claims.

DESCRIPTION OF THE PREFERRED EMBODIMENT

Figure 1:
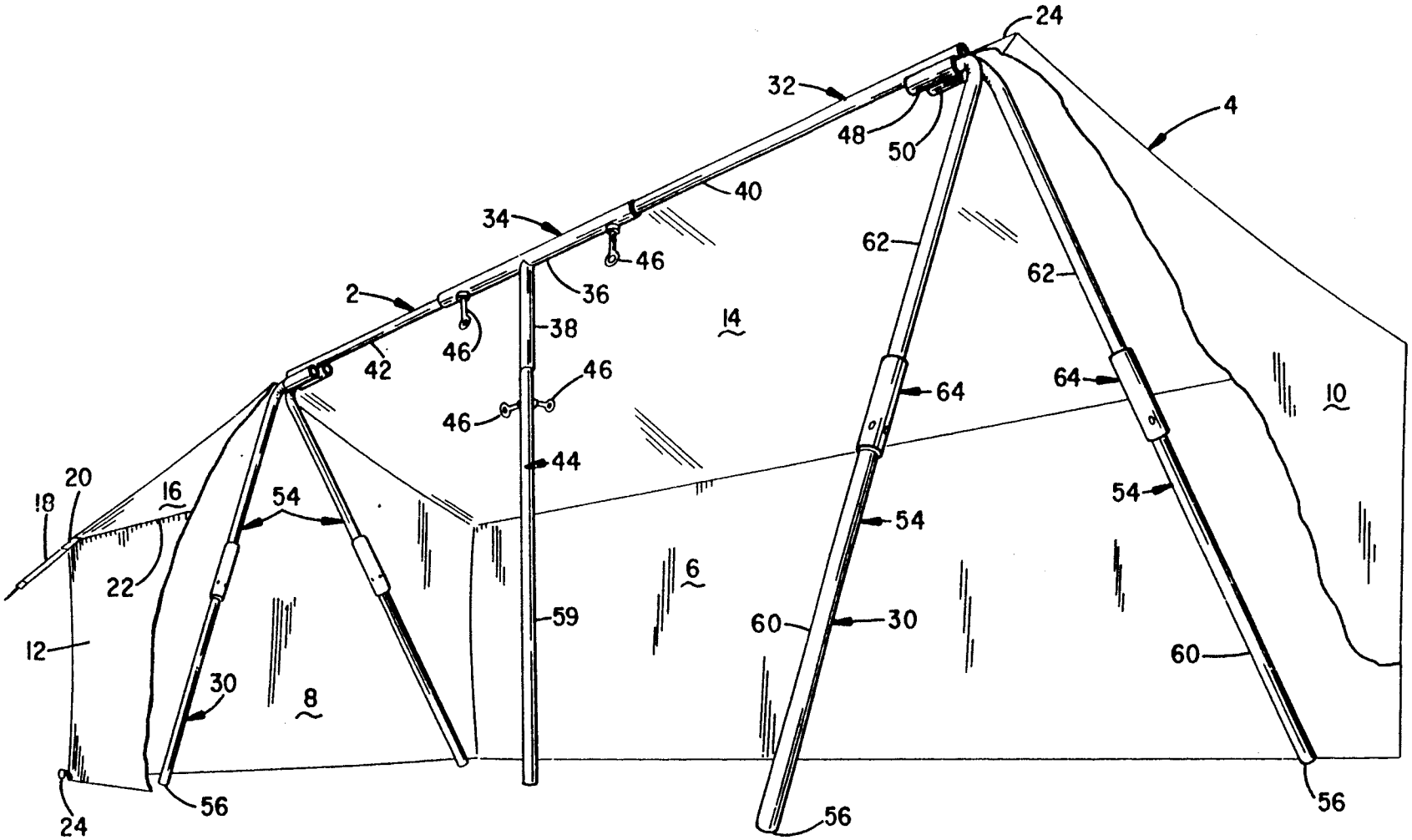
FIG. 1 is an assembled perspective drawing of the framework of the present invention shown in partial cutaway relative to a typical wall tent.

Referring to FIG. 1, a perspective drawing is shown in partial cutaway of the framework 2 of the present invention and in assembled relation to a tent 4. The depicted tent 4 generally comprises a cabin style construction, and is commonly referred to as a wall tent due to the presence of vertical side and end walls 6, 8, 10, and 12, which are not found on many tent designs. Longitudinal roof panels 14 and 16 extend between the end and side walls.

The tent is constructed of a relatively heavy weight cotton or twill corded fabric of a canvas construction. For a tent construction that accommodates a 16×24 living space and a 6'-6" to 10' peak height, the tent fabric may weigh on the order of 25 to 100 pounds. The tent 4 is partially supported by a plurality of length adjustable guy ropes 18 which extend from a plurality of loop fasteners 20 that are sewn to the tent walls and/or roof side wall seams 22. The lower peripheral edges of the tent 2 are staked to the ground with ground pegs 24. Otherwise, the collapsible support framework 2 of the present invention mounts internal to the tent 4 to support the ridge seam 24 and properly define the longitudinal tent length. The framework 2 finds particular advantage not only during initial assembly of the tent 4, but also during periods when the tent 4 is left unattended during rain or snow conditions.

The framework 2 is comprised of a plurality of collapsible sections which are fabricated from lengths of galvanized tubular steel stock, such as electrical conduit. The various frame sections of the presently preferred framework 2 utilize ½, ¾ and 1 inch diameter tubular stock. For economic reasons, the foregoing stock provides advantages, although it is to be appreciated other materials of appropriate dimensions, strength and weight characteristics can be substituted.

The framework 2 includes a pair of inverted V-shaped end support sections 30 which slip couple to a length adjustable ridge pole assembly 32. The ridge pole assembly 32 is also supported at its approximate center via a center T-support assembly 34. Depending upon the tent length, additional vertical support assemblies 32 may be added as necessary or deleted, if not required.

Figure 2:
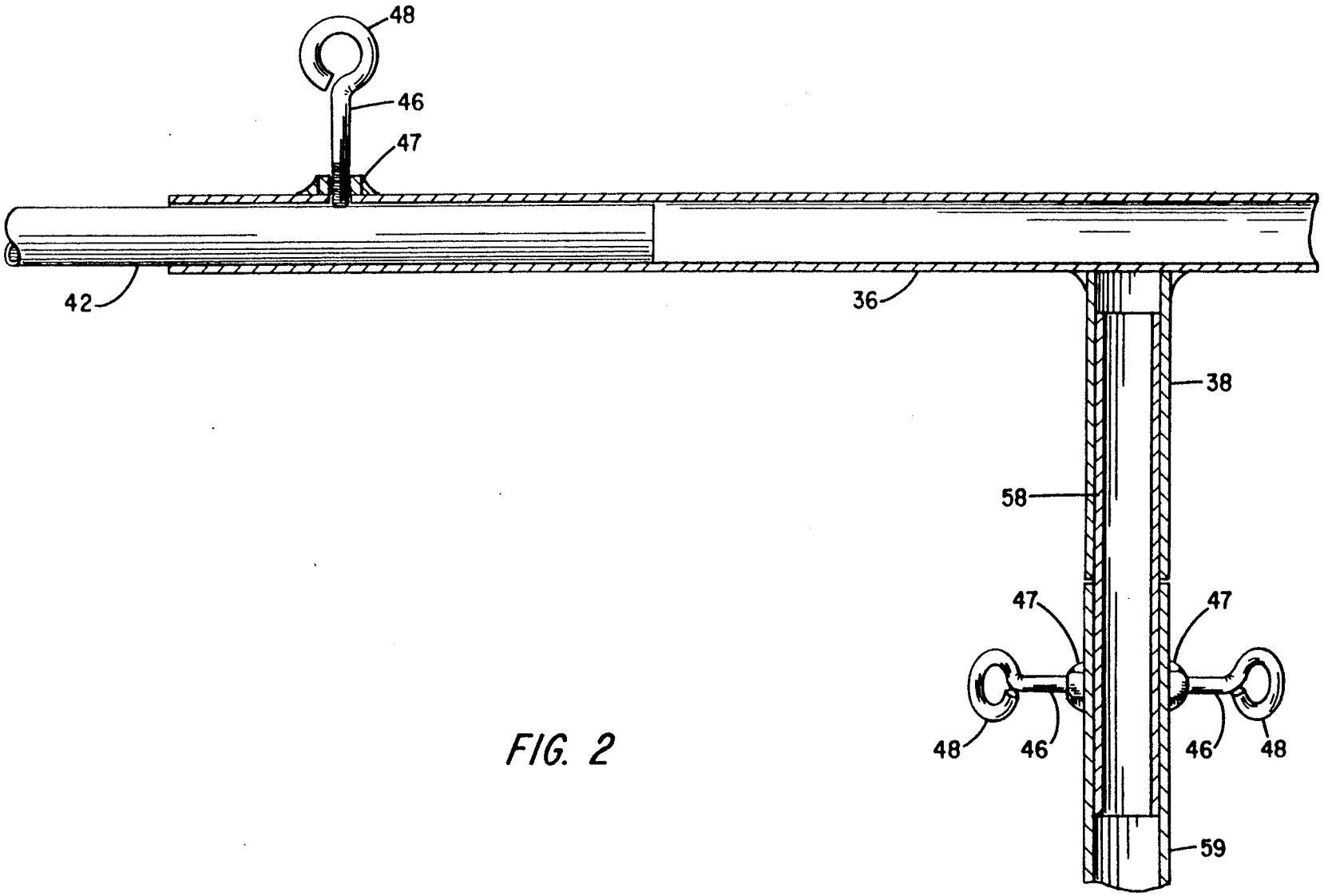
FIG. 2 is a detailed elevation drawing of the center T-support assembly of the framework.

Referring to FIG. 2, a detailed view is shown of the center T-support assembly 34. It comprises a T-shaped body having horizontal and vertical tubular portions 36 and 38. Right and left ridge pole extensions 40 and 42 telescopically mount to the outer ends of the horizontal portion 36. The vertical portion 38, otherwise, receives a length adjustable center support assembly 44.

Provided at each end of the horizontal portion 36 is an eye bolt 46 which is threadably coupled to a nut 47 that is welded in concentric relation to bored holes at the slip coupled horizontal portion 36 and ridge pole extensions 40, 42. Each eye bolt 46 serves as a set screw fastener for fixing the assembled length of the ridge pole assembly 32. An eyelet 48 provides a ready hand grasp which can also serve as an anchor point for a clothes line or support a lantern, etc. The right and left extension pieces 40, 42, otherwise are formed to a sufficient length to accommodate a range of tent lengths.

Figure 3:
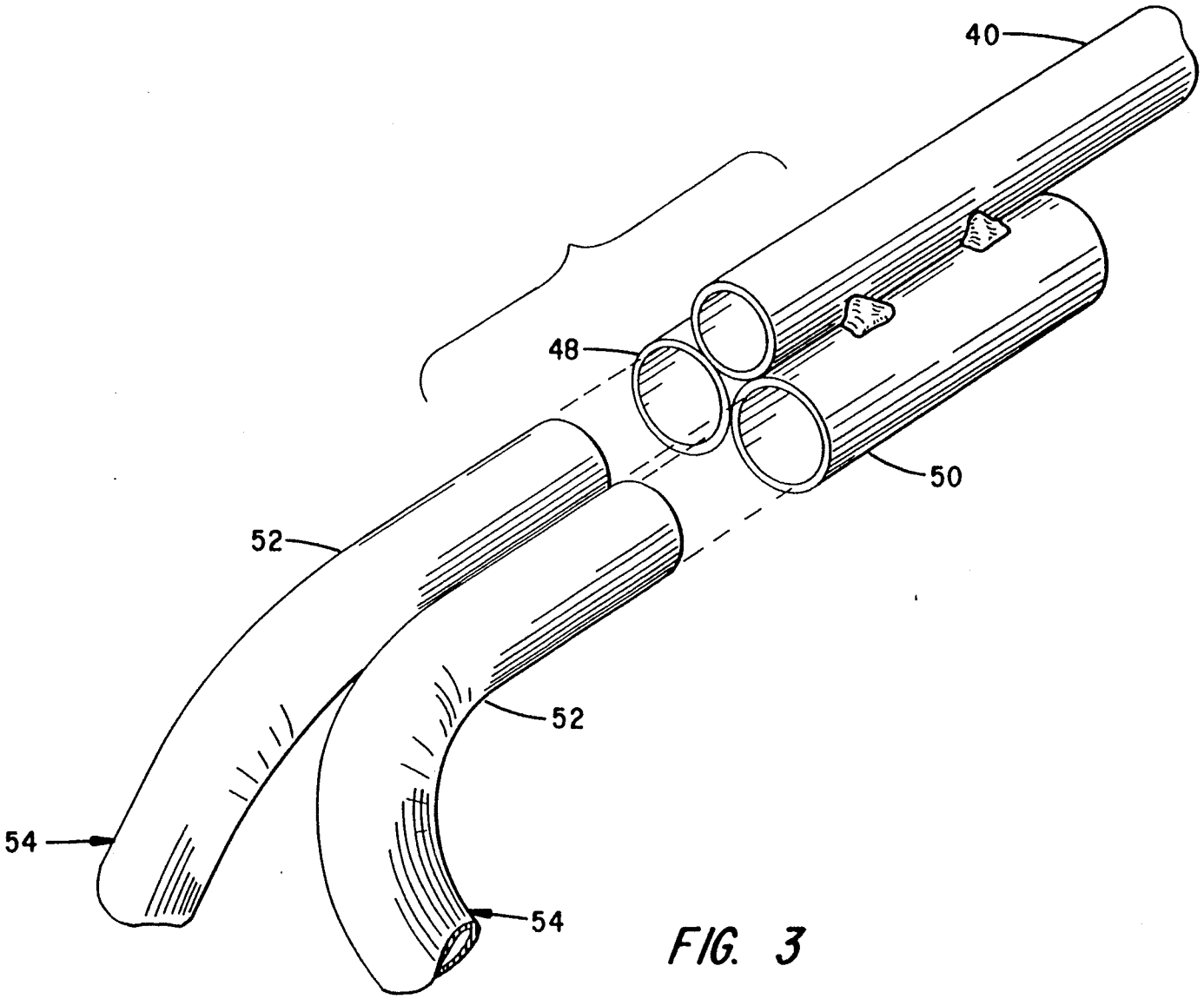
FIG. 3 is a detailed perspective drawing of the slip coupler fastening between the end supports and ridge pole.

With attention to FIG. 3, an outer end of each extension piece 40, 42 includes a pair of parallel positioned, relatively short coupler sections 48, 50 which are welded to the extension pieces 40, 42. The right end of the ridge assembly 32 is depicted, but it is to be appreciated the left end is of identical construction. The couplers 48, 50, each slideably receive a 90 degree bent end 52 of one of a pair of identical multi-section pole supports 54. The pole supports 54 are thus rotatable relative to the sleeve couplers to adjustably determine the spacing between the ground engaging ends 56.

Moreover, upon expanding and fixing the length of the ridge pole assembly 32 relative to the tent end walls 8 and 10, the support sections 30 are restrained to the ridge pole 32 by way of the compressive action of the end walls 8 and 10. Separate fasteners are thereby not required to secure the support poles 54 to the couplers 48, 50 and the support poles 54 are free to rotate and permit periodic adjustment.

Returning attention to the vertical support assembly 44, it comprises an extensible pole 58 that slideably mounts in a lower support pole 59. The top of the pole 58 contacts the horizontal portion 36. The total exposed length and height of the center support assembly 44 is established via a pair of eye bolt fasteners 46 which extend at 90 degrees to one another through the center support pole 59.

The support assembly 44 thus provides a length extensible adjustment to accommodate any sagging of the ridge pole 32. Necessary, height adjustments are also effected thereby, such as when spacing adjustments are made at the end support assemblies 30 or during rain or snow conditions to increase the roof pitch. Because the support poles 54 of the end supports 30 are configured to a predetermined fixed length, any adjustment of the end support angle effects the ridge height.

Figure 4:
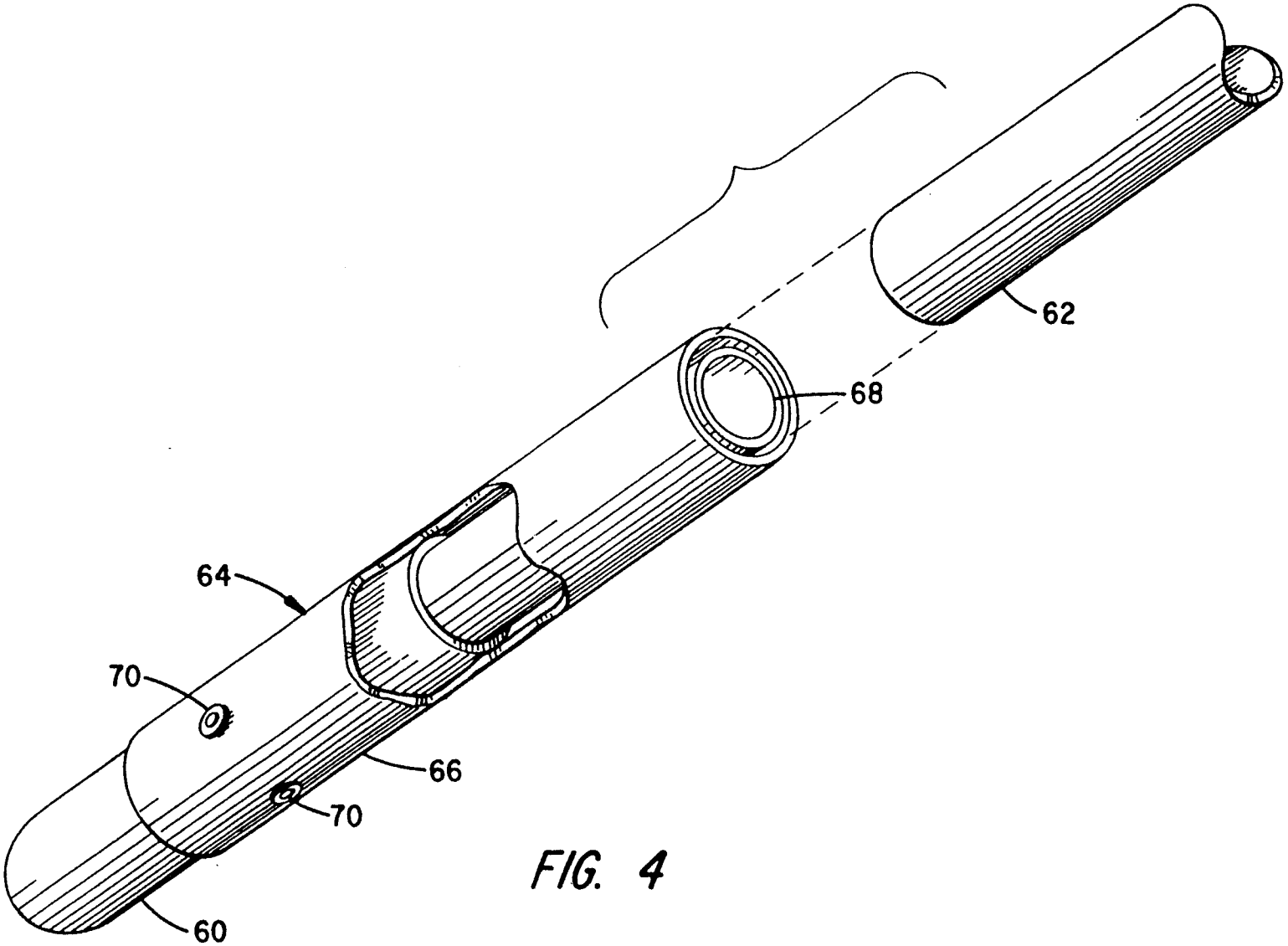
FIG. 4 is a detailed perspective drawing of the coaxial sleeve coupler fasteners of the end supports.

With attention next directed to FIG. 4, it is to be appreciated that each of the end support poles 54 are comprised of two sections 60, 62 which slip fit to one another. The sections 60, 62 mount together at coaxial couplers 64 which provide an annular bore space 66 for receiving and supporting the upper section 62 to the lower section 60.

Each coupler 64 comprises an outer sleeve section 66 having an inside diameter greater than the outer diameter of the support poles 60, 62 and an inner sleeve section 68. The inner and outer sleeves 68, 66 concentrically mount to the lower pole section 60 and are secured to one another with a plurality of rivet fasteners 70. The insertion depth of the upper pole section 62 is determined by the extension of the lower pole section 60 within the sleeve 66. Typically the support poles 60, 62 meet at the middle of the coupler 64.

A particular advantage of the couplers 34 is that the ends of the joined pole sections 60, 62 are captured and constrained by the cooperative action of the inner and outer sleeves 68, 66. A very durable coupling is thus achieved and one which minimizes the chance of buckling of the end supports 30 under typically encountered conditions.

The framework 2 finds particular advantage during initial tent assemblyin that the sections 30, 32, 34 and 44 can be assembled from within the interior of the collapsed tent 4. The erection sequence typically comprises the partial assembly of the ridge pole 32 to a length somewhat shorter than the final length. The upper poles 62 of end wall support sections 30 are next inserted into the rearmost sleeve couplers 48, 50 and partially spread to support and partially raise the tent 4. The end support section 30 adjacent the tent access opening or door flap and the center support pole assembly 44 are next added to partially raise the remainder of the tent over its total length. The lower poles 60 of the end supports 54 are next sequentially added to each end support 54 and the angle of the end supports 54 are properly set. The length of the ridge pole assembly 32 may then be adjusted by way of the eye bolts 46 at the T-support 34. The center support pole is next adjusted to take-up any center sag of the tent 4, once the fabric is pegged to the ground.

Lastly, the guy ropes 18 are appropriately fixed and length adjusted to adjacent structures and/or pegged to the ground to properly support the side walls 6, 12 relative to the assembled framework 2. The total assembly time takes a matter of minutes and requires only a single person, even for tents ranging from ten to twenty feet in length and weighing one hundred pounds or more. Previously, the assembly operation required two persons and an hour or more to merely set the conventional external framework, prior to adjustment of the guy ropes 18.

Disassembly is also greatly improved and is effected in a reverse fashion to that described for erection in a matter of minutes. The disassembled framework sections readily store in a compact bundle, approximately five to six feet long. The sections may be contained within a storage bag for transport to the next campsite.

No longer is it necessary to cut new support poles at each campsite. Nor is it necessary to transport poles which may be ten to fifteen feet in length or longer between campsites. Rather, the disassembled framework 2 may be readily mounted to a packhorse or stored in the bed of a conventional pickup truck.

While the invention has been described with respect to its presently preferred construction, and various considered modifications and improvements thereto, it is to be appreciated still other constructions may suggest themselves to those of skill in the art. Accordingly, the following claims should be interpreted to include all those equivalent embodiments within the spirit and scope thereof.

What is claimed is:

1. An internally mounted tent support assembly for a tent having longitudinal ends and a longitudinal length, said tent support assembly comprising:

(a) first and second end support means for supporting each of the longitudinal ends and each comprising a bent end and a pair of first and second pole sections which mount in coaxial alignment with one another at a coupler means for supporting inner and outer end surfaces of the first and second poles;

(b) ridge support means for supporting a longitudinal length of the tent and including a ridge pole, first and second slip coupler means secured at opposite ends of the ridge pole for each slidably receiving said bent ends of ones of said first and second end support means, whereby an inverted V-shaped support is obtained at each end of the tent upon mounting said first and second end support means to the ridge pole; and (c) vertical support means telescopically receiving said ridge pole and for adjusting the height of the ridge pole relative to the end support means.

2. Apparatus as set forth in claim 1:

(a) wherein said ridge pole is comprised of first and second sections;

(b) wherein said vertical support means includes a T-shaped member having set screw means for length adjustably securing the first and second sections of said ridge pole to a horizontal portion thereof; and (c) including a first vertical support pole coupling to a vertical portion of said T-shaped member and means for telescopically securing a second vertical support pole to the first vertical support pole.

3. Apparatus as set forth in claim 2 wherein said set screw means comprises at least one threaded member secured to said T-shaped member in alignment with a bore hole and a second mating threaded member includes an eyelet formed therein.

4. Apparatus as set forth in claim 3 wherein the first and second pole coupler means of said end support means comprise first and second sleeves concentrically secured to an end of one of the first and second poles and defining an annular cavity whereat an end of the other of the poles is received.

5. An internally mounted tent support assembly for a tent having longitudinal ends and a longitudinal length, said tent support assembly comprising:

(a) first and second end support means comprised of bent ends and a plurality of interconnecting pole sections for supporting each of the longitudinal ends;

(b) ridge support means for supporting a longitudinal length of the tent and including first and second ridge pole sections having first and second slip coupler means respectively secured at opposite ends thereof for each slidably receiving bent ends of ones of said first and second end support means, whereby an inverted V-shaped support is obtained at each end of the tent upon mounting said first and second end support means to the ridge pole; and (c) vertical support means including a T-shaped means for telescopically receiving said first and second ridge pole sections at a horizontal portion and for telescopically adjusting the height of the ridge pole relative to the end support means and having a plurality of eyelet containing set screw coupler means for fixing the length and height of the assembly.

6. Apparatus as set forth in claim 5 wherein each of said first and second end support means comprises a pair of first and second pole sections which mount in coaxial alignment with one another at a coupler means for supporting inner and outer end surfaces of the first and second poles, said coupler means including inner and outer coaxial sleeves and means for securing said sleeves to one of said pole sections, whereby an annular bore is formed to receive the other of said pole sections approximately mid-length of the coupler means.

* * * * *